US006847037B2

(12) United States Patent
Umemura

(10) Patent No.: US 6,847,037 B2
(45) **Date of Patent: *Jan. 25, 2005**

(54) ION TRAP MASS SPECTROMETER

(75) Inventor: Yoshikatsu Umemura, Kyoto-fu (JP)

(73) Assignee: Shimadzu Corporation, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/440,113

(22) Filed: May 19, 2003

(65) Prior Publication Data

US 2003/0213908 A1 Nov. 20, 2003

(30) Foreign Application Priority Data

May 20, 2002 (JP) ..... 2002-143999

(51) Int. Cl.[7] ..... H01J 49/42
(52) U.S. Cl. ..... 250/292
(58) Field of Search ..... 250/292, 282, 250/290, 291

(56) References Cited

U.S. PATENT DOCUMENTS 4,761,545 A * 8/1988 Marshall et al. ..... 250/291
5,449,905 A * 9/1995 Hoekman et al. ..... 250/282
6,624,411 B2 * 9/2003 Umemura ..... 250/292
2001/0010355 A1 8/2001 Umemura ..... 250/282
2003/0071211 A1 4/2003 Kawato ..... 250/300

FOREIGN PATENT DOCUMENTS

JP 2001-210268 8/2001
JP 2003-45372 2/2003

* cited by examiner

*Primary Examiner*—Jack I. Berman
(74) *Attorney, Agent, or Firm*—Westerman, Hattori, Daniels & Adrian, LLP

(57) ABSTRACT

In an ion trap mass spectrometer including a ring electrode and a pair of end cap electrodes placed opposite each other with the ring electrode therebetween, where an ion trap space is defined by the ring electrode and the pair of end cap electrodes, the frequency determining section of the controller determines a plurality of frequencies or a plurality of frequency channels each corresponding to a mass to charge ratio of an ion to be selected. The wide-band RF signal generator generates a wide-band RF signal having a plurality of notches each corresponding to each of the plurality of frequencies or the plurality of frequency channels. Then the voltage controller applies a voltage corresponding to the wide-band RF voltage to the pair of end cap electrodes, whereby ions having mass to charge ratios corresponding to the frequencies or frequency channels remain in the ion trap space but other ions are ejected from the ion trap space.

9 Claims, 6 Drawing Sheets

MASS SPECTRUM BEFORE SELECT

WIDE-BAND SIGNAL

MASS SPECTRUM AFTER SELECT

MASS SPECTRUM BEFORE SELECT

WIDE-BAND SIGNAL

MASS SPECTRUM AFTER SELECT

SINGLE FREQUENCY

WIDE-BAND

WIDE-BAND WITH A NOTCH

MASS SPECTRUM BEFORE SELECT

WIDE-BAND SIGNAL

MASS SPECTRUM AFTER SELECT

ION TRAP MASS SPECTROMETER

The present invention relates to an ion trap mass spectrometer, and especially to a method to select plural object ions from various ions stored in the ion trap.

BACKGROUND OF THE INVENTION

An ion trap mass spectrometer is composed of a ring electrode and a pair of end cap electrodes opposing each other with the ring electrode therebetween. The inner surface of the ring electrode is formed hyperboloid-of-one-sheet-of-revolution and the inner surface of the end cap electrodes are formed hyperboloid-of-two-sheets-of-revolution. When appropriate RF voltages are applied on the ring electrode and the end cap electrodes, a quadrupole electric field is formed in the space ("ion trap space") surrounded by the ring electrode and the end cap electrodes, whereby ions generated in the ion trap space or ions introduced from outside into the space are trapped and stored there.

After ions are trapped in the ion trap space, or while ions are stored there as explained above, various analyzing modes are possible by applying corresponding voltages to the end cap electrodes. FIGS. 5A–5C schematically illustrate some examples of frequency distribution of the RF voltage applied to the end cap electrodes for realizing various analyzing modes.

When, as shown in FIG. 5A, a sinusoidal signal having a certain frequency $f_1$ which corresponds to the mass to charge ratio (m/z) of a certain ion is applied to the end cap electrodes, only the ions resonantly vibrate in the electric field and are ejected from the ion trap space, and other ions do not. When, as shown in FIG. 5B, a wide-band signal including a range of frequencies from $f_2$ to $f_3$ is applied to the end cap electrodes, ions having mass to charge ratio of a certain range corresponding to the frequency range vibrate simultaneously and are ejected from the ion trap space. Further, when, as shown in FIG. 5C, a wide-band signal devoid of a certain narrow range of frequencies from $f_4$ to $f_5$ ("notch") is applied to the end cap electrodes, ions having the mass to charge ratios corresponding to the "notch" frequencies do not vibrate and remain in the ion trap space, while the other ions are ejected from it. Practically, the width of the notch $f_4$–$f_5$ is set appropriately according to the resolution of the ion trap mass spectrometer, so that the desired object ions can be selected and stored in the ion trap space.

When sample molecules or atoms are ionized, the following phenomenon occurs. Generally, atmospheric pressure chemical ionization (APCI) method and electrospray ionization (ESI) method are used for ionizing the sample in a liquid chromatograph/mass spectroscopy (LC/MS). These methods are categorized in soft ionizing methods in the sense that no dissociation of ions occurs. In these ionizing methods, besides a molecular ion $M^+$ which is formed from a molecule minus an electron, various ions are generated such as a molecule plus $H^+$ (proton), $Na^+$ (sodium ion), $K^+$ (potassium ion), $NH_4^+$ (ammonium ions) or a solvent ion, or a dehydrated ion which is a molecule ion minus a water molecule. Those ions are hereinafter referred to as "pseudo-molecular ions". An example of a mass spectrum is shown in FIG. 6, in which dehydrated ion $[M—H_2O]^+$ and a molecular ion $M^+$ are simultaneously generated. As seen in the mass spectrum of FIG. 6, peaks of impurities appear besides peaks of the object molecules.

Irrespective of ionizing methods, it often happens that plural electrical charges are added or deprived of a sample molecule, so that a multivalent ion is produced in the course of the ionization. An example of a mass spectrum including the peaks of multivalent ions is shown in FIG. 7, where peaks of undecavalent (11-valent) and further ions are omitted for visibility of the graph. In this case, also, peaks due to impurities appear.

When a component of an object sample is intended to be analyzed quantitatively with a mass spectrometer, it is necessary to measure not only the molecular ions of the component but also various ions derived from the molecule or atoms of the component. These ions have different mass to charge ratios, and, as shown in FIGS. 6 and 7, give rise to distinct peaks on the abscissa of the mass spectrum.

In conventional ion trap mass spectrometers, a wide-band signal having a notch of a certain width, as shown in FIG. 5C, is prepared for each ion derived from the component molecule that needs to be measured. The notch corresponds to the mass to charge ratio of the ion. Measurements are made one by one for each ion using the wide-band signal, and the results of the measurements are added to obtain the result of analysis.

Such a method is self-evidently complicated and inefficient. When an MS/MS analysis—in which selected ions (precursor ions) are dissociated in the ion trap space, and the mass spectrum of the dissociated fragment ions is obtained—is performed using the method, the amount of precursor ions becomes less and the amount of fragment ions also becomes less, so that an adequate mass spectrum can not be obtained. This deteriorates the detection sensitivity, S/N ratio and precision of the mass to charge ratio of the analysis.

In some ion trap mass spectrometers (ones made by Thermo Finnigan, San Jose, Calif., for example), the width of the notch is increased, or the difference of $f_4$ and $f_5$ in FIG. 5C is enlarged, and the range of mass to charge ratio is increased to cover all of the various ions to be measured. Thus the ion selections are performed simultaneously. In this method, for example, molecular ions $M^+$ and proton-added ions $MH^+$ can be selected simultaneously by enlarging the width of the notch by only 1 amu (if they are monovalent ions).

In order to simultaneously select molecular ions $M^+$ and dehydrated ions $(M—H_2O)^+$ as shown in FIG. 8A, however, the notch width should be broadened by 18 amu than normal, as shown in FIG. 8B. When the notch width is thus broadened, it is probable that undesirable ions fall in the notch and remain in the ion trap space as shown in FIG. 8C. This produces chemical noises in the analysis.

In the case of multivalent ions as shown in FIG. 7, ions belonging to such a group have a wide variety of mass to charge ratios, and it is actually impossible anyway to select those ions simultaneously with the above method.

The present invention addresses the above problem. A primary object of the present invention is to provide an ion trap mass spectrometer that can select molecular ions and pseudo-molecular ions simultaneously, and that can certainly avoid remaining of unwanted ions. Another object of the present invention is to provide an ion trap mass spectrometer that can select multivalent ions having a variety of mass to charge ratios appropriately, and that can certainly avoid remaining of unwanted ions.

SUMMARY OF THE INVENTION

According to the present invention, an ion trap mass spectrometer includes:

a ring electrode and a pair of end cap electrodes placed opposite each other with the ring electrode therebetween, where an ion trap space is defined by the ring electrode and the pair of end cap electrodes;

frequency determining means for determining a plurality of frequencies or a plurality of frequency channels each corresponding to a mass to charge ratio of an ion to be selected;

a wide-band RF signal generator for generating a wide-band RF signal having a plurality of notches each corresponding to each of the plurality of frequencies or the plurality of frequency channels; and a voltage controller for applying a voltage corresponding to the wide-band RF voltage to the pair of end cap electrodes, whereby ions having mass to charge ratios corresponding to the frequencies or frequency channels remain in the ion trap space but other ions are ejected from the ion trap space.

In the ion trap mass spectrometer of the present invention, the wide-band RF signal generator generates a wide-band signal having a plurality of notches which correspond to the frequencies or frequency channels given by the frequency determining means, and an RF voltage corresponding to the wide-band signal is applied to the end cap electrodes. The wide-band signal having such notches can be produced by adding a number of single-frequency sinusoidal signals differing in the frequency from one another by a predetermined step and falling within a wide range of frequencies excluding the frequencies of the notches. When the RF voltage corresponding to the wide-band signal is applied to the end cap electrodes, an electric field is produced in the ion trap space, and ions having mass to charge ratio corresponding to the notch frequency remain in the ion trap but other ions vibrate resonantly and are ejected out of the ion trap. Thus ions of several mass to charge ratios can be selected simultaneously.

In another feature of the present invention, the ion trap mass spectrometer further comprises an input section for inputting primary information which is a mass to charge ratio of an object molecular ion or information that can derive the mass to charge ratio, and for inputting secondary information which can derive a mass to charge ratio of a pseudo-molecular ion; and the frequency determining means determines, based on the primary information and the secondary information, a first frequency or frequency channel of the molecular ion, and a second frequency or frequency channel of the pseudo-molecular ion which is apart from the first frequency or frequency channel by a predetermined value of frequency.

A pseudo-molecular ion is, as explained before, an ion in which a particular component (proton, for example) is added to a molecular ion, or an ion in which a particular ion is subtracted from a molecular ion. Depending on the analyzing conditions (such as the ionizing method or the kind of sample), what kind of pseudo-molecular ions are likely to generate is known. If such conditions, or the component to be added or subtracted to the molecular ion, are input and given as the secondary information, the mass to charge ratio of the pseudo-molecular ions can be calculated using the primary information which is the mass to charge ratio of the molecular ion or other information that can derive it. Using such a structure, molecular ions and pseudo-molecular ions derived from a molecule or atom can be surely and simultaneously selected.

In still another feature of the present invention, the ion trap mass spectrometer comprises an input section for inputting primary information which is a mass to charge ratio of an object molecular ion or information that can derive the mass to charge ratio, and for inputting secondary information which indicates a multivalent ion analysis; and the frequency determining means determines, based on the primary information and the secondary information, a plurality of frequencies or frequency channels corresponding to multivalent ions whose mass to charge ratios fall within a predetermined range of mass to charge ratios to be analyzed.

The mass to charge ratios of multivalent ions (including monovalent ions) can be known if it is informed that a multivalent ion analysis is to be conducted. In the above feature of the ion trap mass spectrometer of the present invention, therefore, the information is inputted as the secondary information in addition to the primary information which is the mass to charge ratio of an object molecular ion or other information that can derive it. Then it is easy to determine the frequencies or frequency channels corresponding to the multivalent ions. If the molecular mass of the object molecule is very large, ions of smaller valence numbers (monovalent ions, for example) may fall out of the mass to charge ratio range that can be analyzed by the ion trap mass spectrometer. In this case, only such multivalent ions whose mass to charge ratios fall within the analyzable range should be selected and only such frequencies or frequency channels corresponding to those ions may be determined. In this feature, multivalent ions derived from an object molecule can be selected simultaneously.

Thus, according to the present invention, a plurality of ions having distinct and separate mass to charge ratios can be selectedly left in the ion trap space while other unnecessary ions are ejected from it. In the ions ejected out of the ion trap are included such ions whose mass to charge ratios fall between the frequencies (or frequency channels) of two kinds of ions that are left in the ion trap space. There is no need to select object ions separately at different timings, so that the analyzing efficiency is much improved. The amount of selected ions is large compared to the conventional method, so that a high-sensitivity, high-precision analysis is possible. Unwanted ions falling between two object ions can be surely avoided, so that noises coming into a mass spectrum are decreased. This leads to a high-precision quantitative as well as qualitative analysis of a sample component.

BRIEF DESCRIPTION OF THE ATTACHED DRAWINGS

DETAIL DESCRIPTION OF PREFERRED EMBODIMENTS

Figure 1:
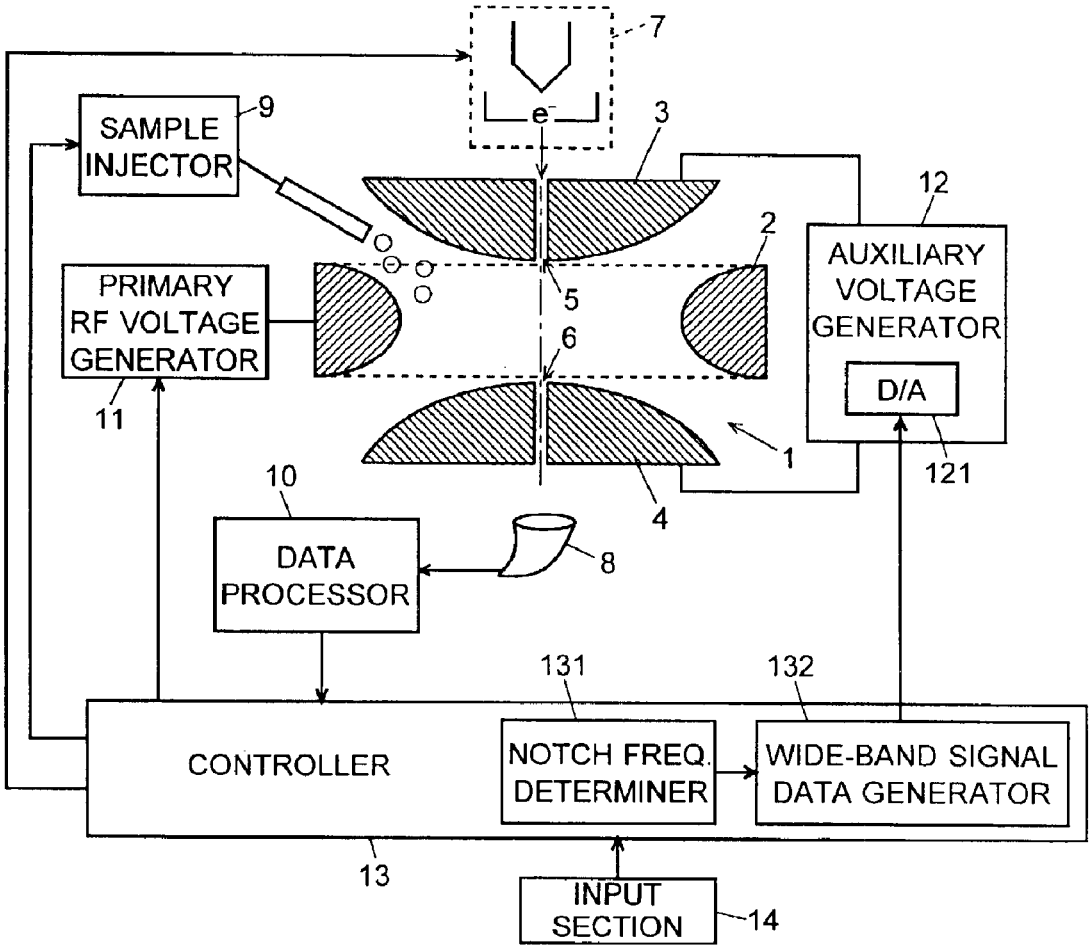
FIG. 1 is a schematic diagram of the ion trap portion and its electrical system of the ion trap mass spectrometer.

An ion trap mass spectrometer embodying the present invention is described referring to the attached drawings. FIG. 1 is a schematic diagram of the ion trap portion and its electrical system of the ion trap mass spectrometer.

The ion trap 1 is substantially composed of a ring electrode 2 and a pair of end cap electrodes 3 and 4 placed opposed to each other with the ring electrode 2 therebetween. The ring electrode 2 has a hyperboloid-of-one-sheet-of-revolution inner surface, and the end cap electrodes 3 and 4 form hyperboloid-of-two-sheets-of-revolution inner surfaces. A primary RF voltage generator 11 is connected to the ring electrode 2, and an auxiliary voltage generator 12 is connected to the first and second end cap electrodes 3 and 4. The first end cap electrode 3 has an entrance hole 5 at its center, and a thermal electron generator 7 is placed just outside the entrance hole 5. Electrons ejected from the thermal electron generator 7 are introduced through the entrance hole 5 into the ion trap 1, and collide with sample molecules introduced there from the sample injector 9, so that the sample molecules are ionized. The second end cap electrode 4 has an exit hole 6 at its center, where the exit hole 6 is aligned with the entrance hole 5. Just outside of the exit hole 6 is placed a detector 8 which detects ions coming out of the ion trap 1 through the exit hole 6. The detection signal is sent from the detector 8 to the data processor 10.

The primary RF voltage generator 11 and the auxiliary voltage generator 12 are controlled by signals from the controller 13. The controller 13 include a CPU, ROM, RAM and other components, and, according to conditions set by the user on the input section 14, sends control signals to respective sections of the mass spectrometer including the primary RF voltage generator 11 and the auxiliary voltage generator 12. The controller 13 includes functional sections of a notch frequency determiner 131 and a wide-band signal data generator 132. The notch frequency determiner 131 calculates out mass to charge ratios of ions to be analyzed based on the conditions given by the user, and determines the notch frequencies corresponding to the mass to charge ratios. The wide-band signal data generator 132 generates digital data corresponding to the wide-band signal having the notches determined by the notch frequency determiner 131. The data is sent to the auxiliary voltage generator 12, where the data is converted to an analog signal by the D/A converter 121, and the analog voltage is applied to the end cap electrodes 3 and 4.

The controller 13 including the wide-band signal data generator 132 is actually realized by a personal computer, and the functional sections described above are realized by programs running on the personal computer.

In the wide-band signal data generator 132, a wide-band signal including notches is produced, where the notches correspond to the frequencies determined by the notch frequency determiner 131. For that processing, a large number of sinusoidal signals of different frequencies excluding the notch frequencies are added. In that process, it is necessary to adequately suppress the amplitude of the resultant addition signal. By appropriately setting the initial phases of the sinusoidal signals to be added (hereinafter, the signals are referred to as "component signals"), the amplitudes of the component signals are adequately canceled while the frequencies of the component signals are incorporated into the resultant addition signal.

A conventional method for such a calculation was as follows. Each time a candidate component signal is added, the initial phase of the candidate component signal is shifted slightly, and the addition is repeated. When the amplitude of the resultant addition signal is minimized, the initial phase at that time is adopted as the component signal to be used for actual adding.

Apparently the method requires a large number of trials, and is inefficient. The applicant of the present application proposed a new method in U.S. patent application Publication No. US2001/0010355A1, corresponding to U.S. Pat. No. 6,624,411, the contents of which are incorporated herein by reference. The mass spectrometer of the present embodiment uses the method disclosed in U.S. Pat. No. 6,642,411 to generate a wide-band signal, so that the number of calculations is easily performable by a normal personal computer while enabling the generation of a satisfactory wide-band signal.

Figure 2:
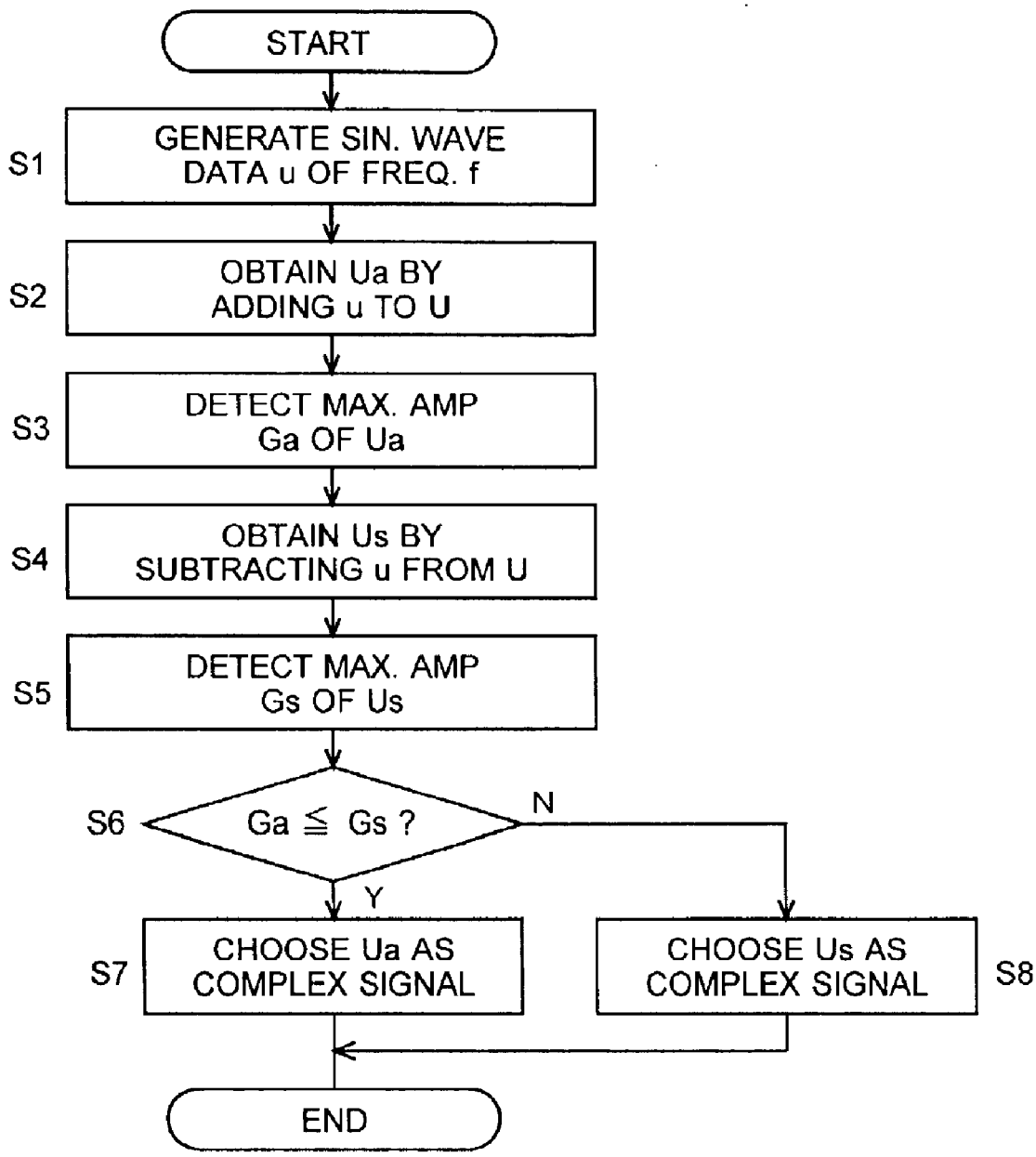
FIG. 2 shows a flowchart of the process of adding a sinusoidal signal of a single frequency to an addition signal.

In the signal generating method, single-frequency sinusoidal signals of frequencies ranging from $f_L$ [Hz] to $f_H$ [Hz] with intervals of $\Delta f$ [Hz] are added. Here the process of adding a sinusoidal signal of a single frequency f to a certain signal (addition signal) is explained in detail. FIG. 2 shows the flowchart of the process. The addition signal is initially zero, is a single sinusoidal signal when a sinusoidal signal is added, and then becomes complex after sinusoidal signals of different frequencies are added.

First, the data u of a sinusoidal signal having a single frequency f, a predetermined amplitude and the initial phase of zero are generated (Step S1). Data of an object signal U and the data u of the sinusoidal signal are added to obtain data of an addition signal Ua (Step S2). The maximum value and minimum value among the data Ua are detected, and the difference between them, which is the maximum amplitude Ga of the addition signal, is calculated (Step S3).

Then the data of the sinusoidal signal u are subtracted from the data of the object signal U to obtain the data Us of a difference signal (Step S4). The maximum value and the minimum value among the data Us are detected, and the difference between them, which is the maximum amplitude Gs of the difference signal, is calculated (Step S5). The amplitudes Ga and Gs are then compared (Step S6). When Ga is smaller, Ua is chosen as the complex signal, and when Gs is smaller, Us is chosen as the complex signal (Steps S7, S8). That is, the complex signal is the signal having the smaller amplitude.

Subtracting a signal of a waveform is the same as adding a signal of an opposite waveform. When the waveform is sinusoidal, it is equal to add a sinusoidal waveform having a 180°-shifted phase. When, in the above method, a sinusoidal signal is to be added, that of zero initial phase or that of 180° initial phase whichever the resultant amplitude is smaller is chosen. And an addition of 180°-initial-phase sinusoidal signal can be replaced by a subtraction of 0°-initial-phase sinusoidal signal. Thus it is sufficient to generate only one sinusoidal waveform for adding a sinusoidal signal of a certain frequency, and it is not necessary to generate various sinusoidal waveforms differing in their initial phase. This reduces the burden of calculations a great deal. The method is confirmed to have the amplitude suppressing effect comparable to that by the conventional method in which an optimal initial phase is determined while the initial phase is shifted step by step.

Additions as described above are repeated with the frequency shifted by $\Delta f$ within the range from $f_L$ to $f_h$ (which corresponds to the range of mass to charge ratio to be analyzed), and the desired wide-band signal is obtained at high speed, where, in the additions, the sinusoidal signal of the frequency at the notch is excluded. Thus the wide-band signal excluding the notch frequency is obtained at high speed.

An example of a mass analysis using the above described ion trap mass spectrometer is described. It is supposed here to analyze molecular ions $M^+$ and dehydrated ions $(M—H_2O)^+$ derived from the molecule of an object sample component. Before the analysis begins, analyzing conditions are set on the input section 14, in which the molecular mass of the object molecule or the mass to charge ratio of the molecular ion is input, and a simultaneous analysis of dehydrated ions is directed. Specifically, an optional item "Analysis of Dehydrated Ions" is prepared in the analysis menu shown on a screen of a display, and the user can simply choose the item.

When the above conditions are set as well as other conditions, the frequency $f_1$ corresponding to the molecular ions is calculated from the molecular mass of the object molecule or the mass to charge ratio of the molecular ion, and the frequency $f_2$ corresponding to the dehydrated ions is also calculated. Then a frequency channel $[f_1]$ centering the frequency $f_1$ and another frequency channel $[f_2]$ centering the frequency $f_2$ both having a predetermined width are determined and sent to the wide-band signal data generator 132.

Figure 3A:
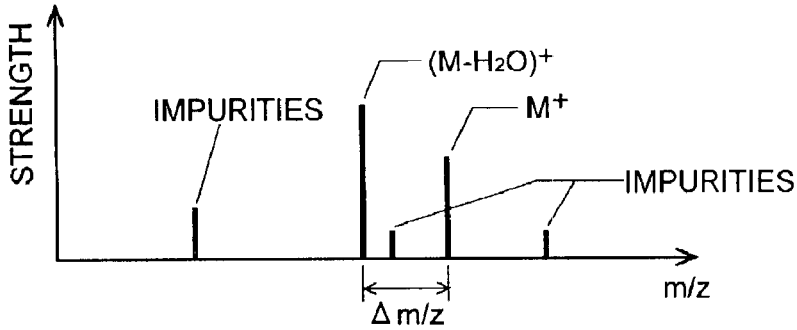
FIG. 3A is a mass spectrum before object ions are selected.
Figure 3B:
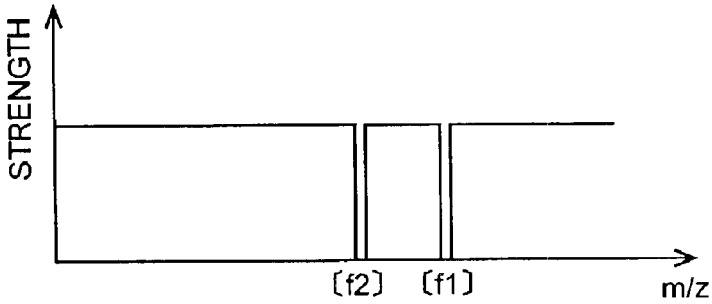
FIG. 3B shows a wide-band signal having two notches corresponding to a molecular ion and a pseudo-molecular ion generated according to an embodiment of the present invention.
Figure 3C:
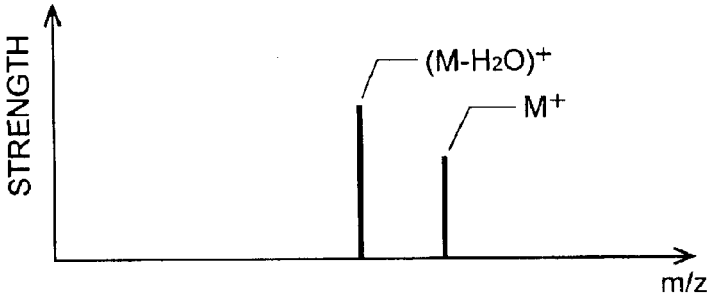
FIG. 3C is a mass spectrum after object ions are selected using the wide-band signal.

The wide-band signal data generator 132 adds a large number of single-frequency sinusoidal signals within a predetermined frequency range but excluding the frequency channels $[f_1]$ and $[f_2]$, as described before, whereby the wide-band signal as shown in FIG. 3B is generated. When or after various ions are stored in the ion trap 1, the wide-band signal is applied from the auxiliary voltage generator 12 to the end cap electrodes 3 and 4. In the ion trap 1, ions corresponding to the notch frequencies do not vibrate resonantly, but other ions do and are ejected from the ion trap 1 through the holes 5 and 6. Thus only molecular ions and dehydrated ions of the object molecule remain in the ion trap 1. Then the remaining ions are ejected from the ion trap 1 through the exit hole 6, and are detected by the detector 8. As a result, a high purity mass spectrum as shown in FIG. 3C is obtained, which is contrasted against the mass spectrum of FIG. 3A which is obtained by the conventional method not using such an ion selection.

Similarly to the above example, a list of other pseudo-molecular ions can be shown on the screen of the display, and, when one or several of pseudo-molecular ions are selected by the user, the corresponding frequency channel or channels are determined. It is further possible to show a box on the screen to allow the user to input a difference in the mass to charge ratio from the molecular ion. When a difference value is input, corresponding frequency $f_2$ is calculated, and the frequency channel $[f_2]$ is determined using the value, in which later part of the process is the same as the above-explained example.

Another example analysis using the above described ion trap mass spectrometer is described. It is supposed to analyze multivalent ions derived from the molecule of an object sample component. Before the analysis begins, the user sets analyzing conditions on the input section 14, in which the molecular mass of the object molecule or the mass to charge ratio of the monovalent molecular ion is input, and a simultaneous analysis of multivalent ions is directed. Specifically, an optional item "Analysis of Multivalent Ions" is prepared in the analysis menu shown on a screen of a display, and the user can simply choose the item.

When the above conditions are set as well as other conditions, the frequencies $f_1, f_2, f_3, \ldots$ corresponding to the multivalent ions are calculated from the molecular mass of the object molecule or the mass to charge ratio of the monovalent molecular ion, where the valence number may be restricted appropriately. Then frequency channels $[f_1]$, $[f_2]$, $[f_3]$, . . . centering the frequencies $f_1, f_2, f_3, \ldots$ having a predetermined width are determined and sent to the wide-band signal data generator 132.

Figure 4A:
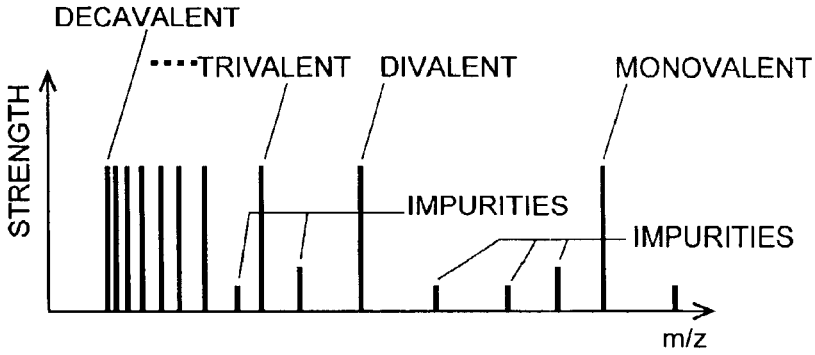
FIG. 4A is a mass spectrum before object ions are selected.
Figure 4B:
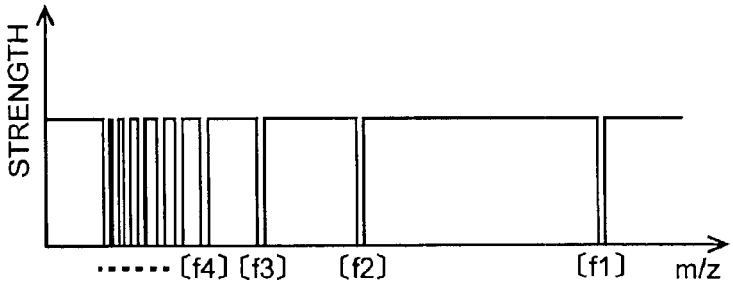
FIG. 4B shows a wide-band signal having several notches corresponding to multivalent ions and generated according to another embodiment of the present invention.
Figure 4C:
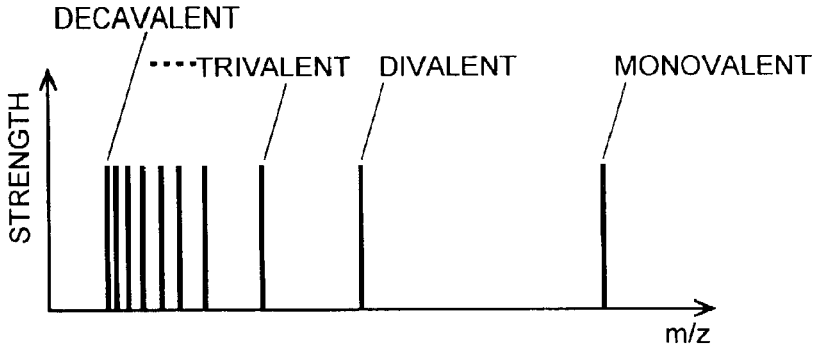
FIG. 4C is a mass spectrum after object ions are selected using the wide-band signal.
Figure 5A:
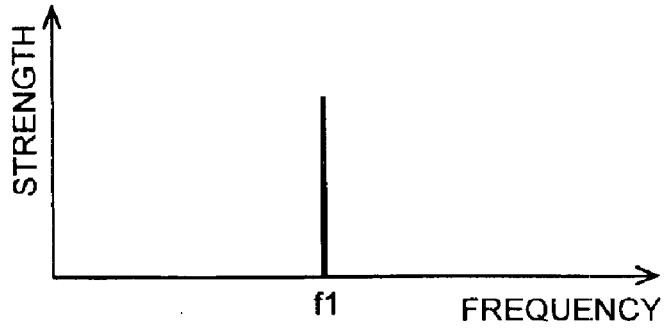
FIG. 5A is a frequency distribution of a single frequency signal.
Figure 5B:
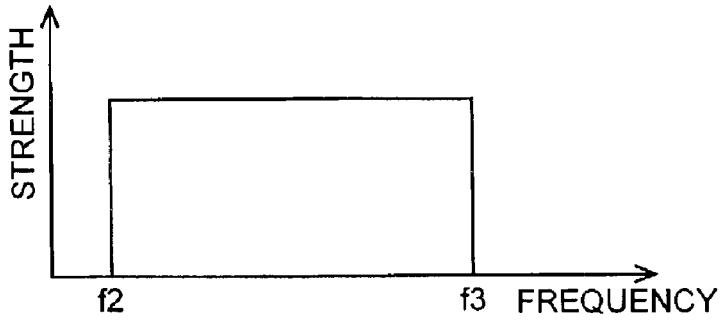
FIG. 5B is that of a wide-band signal and FIG. 5C is that of a wide-band signal having a notch, all used in conventional methods.
Figure 5C:
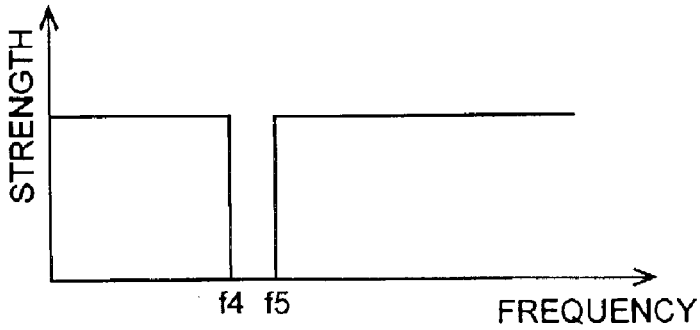
Figure 6:
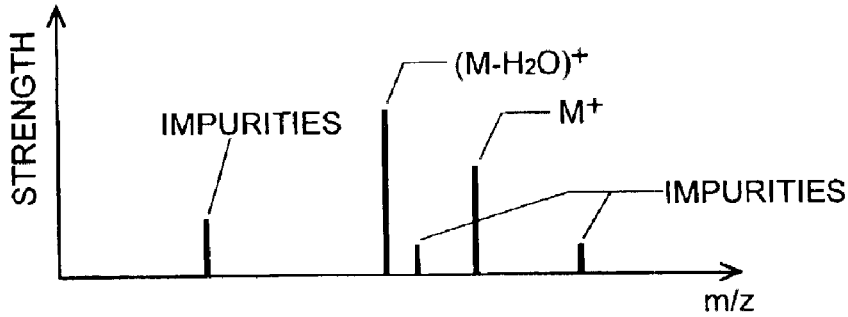
FIG. 6 is a mass spectrum including a molecular ion $M^+$ and a dehydrated ion $(M—H_2O)^+$.
Figure 7:
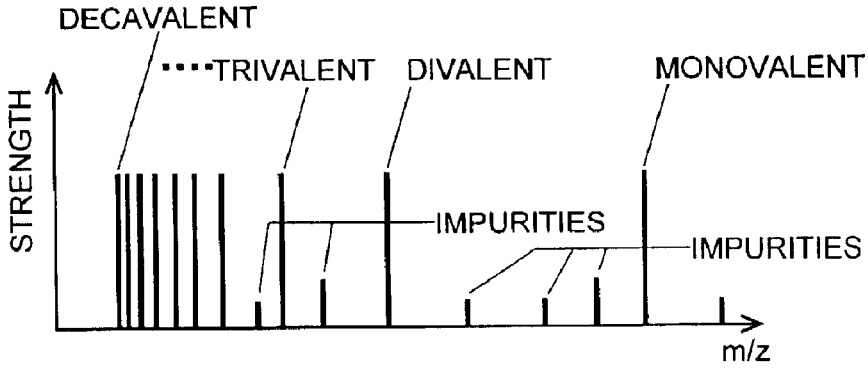
FIG. 7 is a mass spectrum including multivalent ions.
Figure 8A:
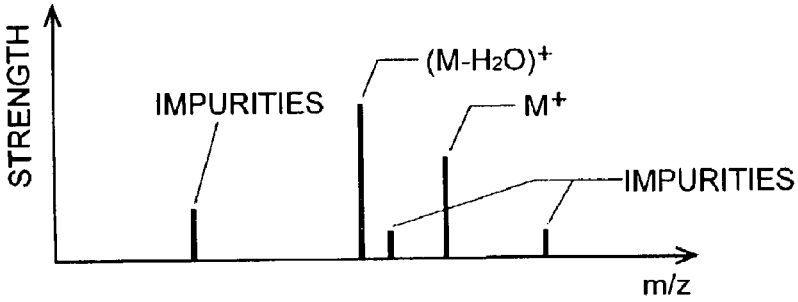
FIG. 8A is a mass spectrum before selection including a molecular ion $M^+$ and a dehydrated ion $(M—H_2O)^+$.
Figure 8B:
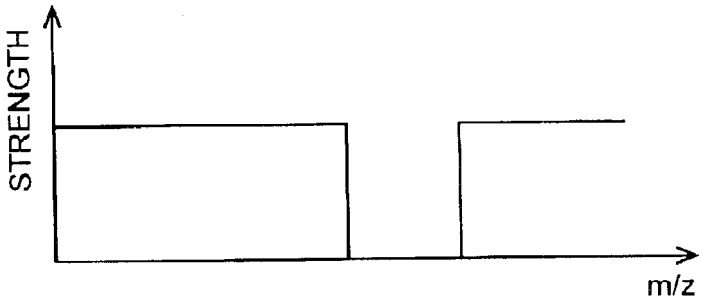
FIG. 8B is a wide-band signal having a wide notch according to a conventional method.
Figure 8C:
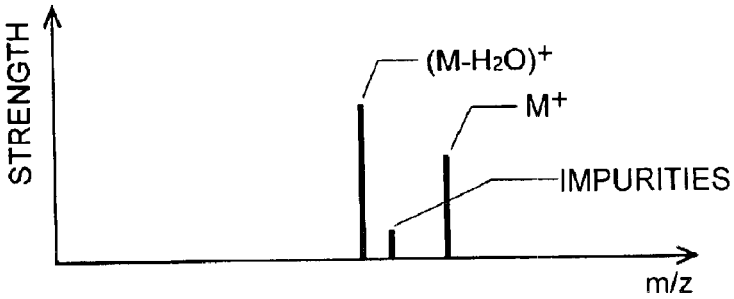
FIG. 8C is a mass spectrum after selection including an unwanted ion between object ions.

The wide-band signal data generator 132 adds a large number of single-frequency sinusoidal signals within a predetermined frequency range but excluding the frequency channels $[f_1], [f_2], [f_3], \ldots$, as described before, whereby the wide-band signal as shown in FIG. 4B is generated. When or after various ions are stored in the ion trap 1, the wide-band signal is applied from the auxiliary voltage generator 12 to the end cap electrodes 3 and 4. In the ion trap 1, ions corresponding to the notch frequencies do not vibrate resonantly, but other ions do and are ejected from the ion trap 1 through the holes 5 and 6. Thus only multivalent ions of the object molecule remain in the ion trap 1. Then the remaining ions are ejected from the ion trap 1 through the exit hole 6, and are detected by the detector 8. As a result, a high purity mass spectrum as shown in FIG. 4C is obtained, which is contrasted against the mass spectrum of FIG. 4A which is obtained by the conventional method not using such an ion selection.

If the molecular mass of an object molecule is very large, ions of small valence numbers may fall out of the measurable mass to charge ratio range, but ions of large valence numbers may fall within the measurable range and can be analyzed. In such a case, according to the present invention, it is possible to select only multivalent ions that fall within the measurable range and produce a mass spectrum as described above.

The method of generating data in the wide-band signal data generator 132 is not limited to the above described one. For example, the signal generating method proposed in U.S. patent application Publication No. US2003/0071211A1, corresponding to U.S. Pat. No. 6,649,911, the contents of which are incorporated herein by reference, by the applicant of the present invention can bring about the same result by setting the generating conditions appropriately.

What is claimed is:

1. An ion trap mass spectrometer comprising:

a ring electrode and a pair of end cap electrodes placed opposite each other with the ring electrode therebetween, where an ion trap space is defined by the ring electrode and the pair of end cap electrodes;

frequency determining means for determining a plurality of frequencies or a plurality of frequency channels each corresponding to a mass to charge ratio of an ion to be selected;

wide-band RF signal generator for generating a wide-band RE signal having a plurality of notches each corresponding to each of the plurality of frequencies or the plurality of frequency channels, wherein the wide-band RF generator generates the wide-band RF signal by:

a) generating a sinusoidal wave having one of a plurality of component frequencies composing the wide-band RF signal devoid of the plurality of frequencies or the plurality of frequency channels corresponding to the plurality of notches;

b) adding the sinusoidal wave to a current temporary superposed wave to produce an addition wave;

c) subtracting the sinusoidal wave from the current temporary superposed wave to produce a subtraction wave;

d) selecting either of the addition wave or the subtraction wave that has a smaller amplitude as a next temporary superposed wave; and e) repeating the steps a)–d) for all the component frequencies; and a voltage controller for applying a voltage corresponding to the wide-band RF voltage to the pair of end cap electrodes, whereby ions having mass to charge ratios corresponding to the frequencies or frequency channels remain in the ion trap space but other ions are ejected from the ion trap space.

2. An ion trap mass spectrometer comprising:

a ring electrode and a pair of end cap electrodes placed opposite each other with the ring electrode therebetween, where an ion trap space is defined by the ring electrode and the pair of end cap electrodes;

frequency determining means for determining a plurality of frequencies or a plurality of frequency channels each corresponding to a mass to charge ratio of an ion to be selected;

wide-band RF signal generator for generating a wide-band RF signal having a plurality of notches each corresponding to each of the plurality of frequencies or the plurality of frequency channels, wherein the wide-band RF generator generates the wide-band RF signal by substantially scanning a plurality of frequencies composing the wide-band RF signal devoid of the plurality of frequencies or the plurality of frequency channels corresponding to the plurality of notches, and said wide-band RF signal is made anti-symmetric at around the plurality of frequencies or the plurality of frequency channels; and a voltage controller for applying a voltage corresponding to the wide-band RF voltage to the pair of end cap electrodes, whereby ions having mass to charge ratios corresponding to the frequencies or frequency channels remain in the ion trap space but other ions are ejected from the ion trap space.

3. The ion trap mass spectrometer according to either claim 1 or 2, wherein the ion trap mass spectrometer further comprises an input section for inputting primary information which is a mass to charge ratio of an object molecular ion or information that can derive the mass to charge ratio, and for inputting secondary information which can derive a mass to charge ratio of a pseudo-molecular ion, and the frequency determining means determines, based on the primary information and the secondary information, a first frequency or frequency channel of the molecular ion, and a second frequency or frequency channel of the pseudo-molecular ion which is apart from the first frequency or frequency channel by a predetermined value of frequency.

4. The ion trap mass spectrometer according to claim 3, wherein the input section shows an item of a pseudo-molecular ion or a list of pseudo-molecular ions on a screen of a display enabling a user of the mass spectrometer to choose one or more pseudo-molecular ions, and the frequency determining means determines the second frequency or frequency channel corresponding to the chosen pseudo-molecular ion or ions.

5. The ion trap mass spectrometer according to claim 3, wherein the pseudo-molecular ion is a dehydrated ion.

6. The ion trap mass spectrometer according to claim 4, wherein the input section shows an item of a dehydrated ion on a screen of a display enabling a user of the mass spectrometer to choose an analysis of the dehydrated ion, and the frequency determining means determines the second frequency or frequency channel corresponding to the dehydrated ion of the object molecular ion.

7. The ion trap mass spectrometer according to claim 3, wherein the input section allows a user of the mass spectrometer to designate a difference in the mass to charge ratio from the molecular ion, and the frequency determining means determines the second frequency or frequency channel corresponding to the designated difference.

8. The ion trap mass spectrometer according to either claim 1 or 2, wherein the ion trap mass spectrometer further comprises an input section for inputting primary information which is a mass to charge ratio of an object molecular ion or information that can derive the mass to charge ratio, and for inputting secondary information which indicates a multivalent ion analysis, and the frequency determining means determines, based on the primary information and the secondary information, a plurality of frequencies or frequency channels corresponding to multivalent ions whose mass to charge ratios fall within a predetermined range of mass to charge ratios to be analyzed.

9. The ion trap mass spectrometer according to claim 8, wherein then input section shows an item of multivalent ions on a screen of a display enabling a user of the mass spectrometer to choose an analysis of the multivalent ions, and the frequency determining means determines the plurality of frequencies or frequency channels corresponding to the multivalent ions of the object molecular ion.

* * * * *